United States Patent [19]

Knapp et al.

[11] Patent Number: 4,565,765

[45] **Date of Patent: * Jan. 21, 1986**

[54] PROCESS OF DEVELOPING ELECTROSTATIC LATENT IMAGES COMPRISED OF ROTATING MAGNETS CONTAINED IN STATIONARY SHELL AND SYNTHETIC CARRIER

[75] Inventors: John F. Knapp, Fairport; Leon A. Howland, Williamson; Robert J. Gruber, Pittsford; Ronald J. Koch, Rochester, all of N.Y.

[73] Assignee: Xerox Corporation, Stamford, Conn.

[ * ] Notice: The portion of the term of this patent subsequent to Jul. 19, 2000 has been disclaimed.

[21] Appl. No.: 552,934

[22] Filed: Nov. 17, 1983

[51] Int. Cl.[4] ..... G03G 13/08; G03G 13/09

[52] U.S. Cl. ..... 430/122; 118/657

[58] Field of Search ..... 430/122; 118/657

[56] References Cited

U.S. PATENT DOCUMENTS

| | | | |
|---|---|---|---|
| 3,900,001 | 8/1975 | Fraser et al. | 118/658 |
| 3,906,121 | 9/1975 | Fraser et al. | 430/122 |
| 4,288,515 | 9/1981 | Yamashita et al. | 430/122 X |
| 4,318,607 | 3/1982 | Bonham et al. | 118/657 X |
| 4,344,694 | 8/1982 | Ruh | 118/661 X |
| 4,345,014 | 8/1982 | Oka et al. | 430/122 |
| 4,368,970 | 1/1983 | Hays | 118/658 X |
| 4,376,813 | 3/1983 | Yuge et al. | 118/657 X |
| 4,394,429 | 7/1983 | Hays | 118/657 X |
| 4,447,517 | 5/1984 | Yuge et al. | 430/122 |

*Primary Examiner*—John E. Kittle
*Assistant Examiner*—Mukund J. Shah
*Attorney, Agent, or Firm*—E. O. Palazzo

[57] ABSTRACT

This invention is directed to an improved process for developing electrostatic latent images comprising (1) providing a development zone situated between an imaging member and a transporting member, comprised of a stationary shell containing rotating magnets therein, (2) transporting synthetic developer composition into the development zone by causing rotation of the magnets in the stationary shell, (3) effecting movement of the imaging member in a direction opposite to the direction of movement of the rotating magnets, wherein the developer composition is desirably agitated in the development zone by magnetic means, and wherein developer particles are available immediately adjacent the imaging member; the developer particles comprised of toner resin particles and carrier particles comprised of resin particles and magnetite; with the distance between the imaging member and stationary shell being from about 0.1 millimeter to about 1.5 millimeters.

22 Claims, 3 Drawing Figures

PROCESS OF DEVELOPING ELECTROSTATIC LATENT IMAGES COMPRISED OF ROTATING MAGNETS CONTAINED IN STATIONARY SHELL AND SYNTHETIC CARRIER

BACKGROUND OF THE INVENTION

This invention generally relates to a process for causing the development of images in electrostatographic systems, and more specifically, the present invention is directed to an improved process for accomplishing the development of electrostatic latent images with a synthetic developer composition. In one embodiment the process of the present invention is accomplished in a development apparatus wherein there is provided an agitated development zone encompassed by an imaging member and a transporting member, which in a preferred embodiment is comprised of rotating magnets contained in a stationary shell. Synthetic developer particles contained in the development zone are caused to desirably agitate by the relative movement of the imaging member and rotating magnets. The process of the present invention allows the continual development of high quality images, including the efficient and effective development of solid areas.

The development of images by electrostatic means is well known. Thus, for example, in these systems, toner particles are applied to electrostatic latent images by various methods including cascade development, magnetic brush development, powder cloud development, and touchdown development. Cascade development and powder cloud development methods were found to be especially well suited for the development of line images common to business documents, however, images containing solid areas were not faithfully reproduced by these methods. Magnetic brush development systems, however, provide an improved method for producing both line images and solid area.

In magnetic brush development systems it is usually desirable to attempt to regulate the thickness of the developer composition, which is transported on a roller by moving the roller past a metering blade. The adjustment of the metering blade is important since in the development zone the flow of developer material is determined by a narrow restrictive opening situated between a transport roller and the imaging surface. Accordingly, in order to provide sufficient toner particles to the imaging surface, it is generally necessary to compress the developer bristles, thereby allowing toner particles adhering to the carrier particles near the ends of the bristle to be available for development. Any variation, or non-uniformity in the amount of developer metered onto the transport roller, or into the spacing between the transport roller and imaging member can result in undesirable developer flow, and non-uniform image development. Non-uniform development is usually minimized by carefully controlling developer runout on the transport roller, and on the imaging member, and by providing a means for side-to-side adjustment in the relative positions of the metering blade, development roller and imaging member.

Moderate solid area development with magnetic brush is usually achieved by transporting the developer composition on a roller at a speed that exceeds the process speed of the image bearing member. At high process speeds the development-transport roller speed is limited by centrifugal forces, which forces cause the developer material to be removed from the roller. Thus, in order to obtain moderate solid area development at high process speeds, the use of multiple development rolls is necessary for increased developability.

The developer materials presently used in magnetic brush development differ widely in their electrical conductivity, thus at one extreme in conductivity, such materials can be insulating, in that a low electrical current is measured when a voltage is applied across the developer. Solid area development with insulating developer compositions is accomplished by metering a thin layer of developer onto a development roll, which is in close proximity to an image bearing member, the development roll functioning as an electrode, and thus increasing the electrostatic force acting on the toner particles. In these systems, the spacing between the image bearing member, and the development roller must be controlled to ensure proper developer flow, and uniform solid area development, the minimum average spacing generally being typically greater than 1.5 millimeters.

Insulating developer compositions can be rendered conductive by utilizing a magnetic carrier material which supports a high electric current flow in response to an applied potential. Generally, the conductivity of developer compositions depends on a number of factors including the conductivity properties of the magnetic carrier, the concentration of the toner particles, the magnetic field strength, the spacing between the image bearing member and the development roll, and developer degradation due to toner smearing on the carrier particles. Also, when insulative toner particles are permanently bonded to a conductive carrier, the conductivity decreases to a critical value below which solid area development becomes inadequate, however, within certain limits the process and material parameters can be adjusted somewhat to recover the decrease in solid area developability.

When using conductive developer materials in electrostatographic imaging systems, the development electrode member is maintained at a close effective distance from the image bearing member, and a high electrostatic force acts only on those toner particles which are adjacent to the image bearing member. Accordingly, since the electrostatic force for development in such systems is not strongly dependent on the developer layer thickness, the uniformity of solid area development is improved despite variations in the spacing between the image bearing member and the development roller member. More specifically, for example, in magnetic brush development systems utilizing conductive developer materials, solid area deposition is not limited by a layer of net-charged developer near the imaging member, since this charge is dissipated by conduction to a development roller. The solid area deposition is, however, limited by image field neutralization; provided there is sufficient toner available at the ends of the developer brush, which toner supply is limited to the ends or tips of the bristles, since toner cannot be extracted from the bulk of the developer mixture; wherein high developer conductivity collapses the electric field within the developer at any location, and confines it to a region between the latent image and the developer. For either insulative or conductive developer, solid area deposition is limited by toner supply at low toner concentrations, and the toner supply is limited to a layer of carrier material adjacent to the image bearing member, since the magnetic field stiffens the developer, and hinders developer mixing in the development zone.

In the above-described systems, undesirable degradation or deterioration of the developer particles results. This is generally caused by a variety of factors, including for example, the frequency and intensity of collisions between adjacent carrier particles contained in the developer composition, which collisions adversely affect the developer conductivity, and the triboelectric charging relationships between the toner particles and magnetic carrier particles. Thus, for example, a decrease in the triboelectric charge on the toner particles causes an increase in solid area development, and an increase in the amount of toner particles that are deposited in the background, or normally white areas of the image, accordingly, in order to maintain the original image quality in such situations, the triboelectric charge on the toner particles is increased, by reducing the concentration of such particles in the developer composition mixture. Also, when the toner charge, and toner concentration decreases, the developer material must be replaced in order to obtain images with acceptable solid areas decreased background.

While several improved types of toner and carrier materials, as well as processes have been developed for the purpose of developing images, difficulties continue to be encountered in the design of a simple, inexpensive, and reliable two-component development system which will provide a high solid area development rate, low background deposition, and long term stability. The present magnetic brush systems are inherently inefficient primarily since only a small fraction of the toner transported through the development zone is accessible for deposition onto the image bearing member. For insulative developer, the solid area deposition is limited by a layer of net-charged carrier particles produced by toner development onto a precharged imaging member. Since the developer entering the development zone has a neutral charge, deposition of charged toner onto the imaging member produces a layer of oppositely charged developer which opposes further toner deposition. Also, the net electrostatic force due to the charged image member, and the net-charged developer layer becomes zero for that toner between the developer and the electrostatic latent image of the imaging member, and a collapse in the electrostatic force, or the electric field acting on the charged toner, occurs even though the toner charge deposited on the photoreceptor does not neutralize the image charge. Image field neutralization can be approached, however, if there is a sufficiently high developer flow rate, and multiple development rollers. Image field neutralization results when the potential due to a layer of charged toner deposited on the imaging member is equal but opposite to the potential due to the charged imaging member. In the absence of a bias on the development roller, image neutralization produces a zero development electric field, and since the toner layer is of finite thickness, the charge density of the toner layer is less than the image charge density. Should the thickness of the charged toner layer be much less than the imaging member, image field neutralization occurs when the toner charge density neutralizes the image charge density.

There is disclosed in U.S. Pat. No. 4,394,429 and U.S. Pat. No. 4,368,970, an imaging process and apparatus containing a development means which is comprised of a tensioned deflected flexible imaging member, and a transporting means with a development zone being situated between the imaging means and the transporting means. The development zone contains therein electrically insulating toner particles and electrically insulating magnetic carrier particles. Movement of the flexible imaging member means and the transporting means in opposite directions at the different speeds causes the developer particles contained in the development zone to desirably agitate. In this process, however, a magnetic field is not present and furthermore a synthetic developer composition is not selected for use in the system.

Furthermore, there is described in U.S. Pat. No. 4,376,813, an improved reversal development method which involves forming a magnetic brush around an outer circumferential surface of a developing sleeve accommodating a magnet therein by the use of a developer composition comprised of high resistivity magnetic toner, and rubbing a surface of the electrostatic latent image with the magnetic brush. Additionally, U.S. Pat. No. 4,345,014, discloses a magnetic brush development method wherein there is selected a dual component development material which includes electrically insulating magnetizable particles as carrier substances, and electrically insulating non-magnetic particles as a toner composition. Accordingly in this patent, there is illustrated a developer composition which is comprised of carrier particles of for example magnetite, ferrite, or pure iron containing therein a bonding material, such as heat hardening resins including phenolic resins, reference Col. 3, beginning at line 60 of the U.S. Pat. No. 4,345,014.

Moreover, there is described in U.S. Pat. No. 4,344,694, a development apparatus wherein there is selected as developing component, toner particles containing a ferromagnetic material in powder form, or a mixture of toner and carrier particles which may contain iron particles or other ferromagnetic material, reference Col. 2, beginning at around line 40.

The art of xerography nevertheless continues to advance and there continues to be a need for improved processes and apparatuses for causing development of images in an efficient and economical manner. Additionally, there continues to be a need for improved processes wherein there is obtained images of high quality and excellent resolution. Furthermore, there continues to be a need for improved processes wherein there is selected as a developer compositions toner resin particles and carrier resin particles. Furthermore, there is a need for an improved development process wherein the carrier particles are within a size range so as to prevent bead carry out or consumption of the carrier particles during the electrophotographic process. By bead carry out in accordance with the process of the present invention is meant carrier particles sticking to the photoreceptor during development and being carried out of the development sub-system and consumed either on the output copy or in the cleaner assembly. Additionally, there continues to be a need for the provision of an improved process wherein background development in substantially eliminated and wherein the life of the developer composition is increased.

SUMMARY OF THE INVENTION

It is therefore an object of the present invention to provide a development process which overcomes the above-noted disadvantages.

It is a further object of the present invention to provide a magnetically agitated development process which allows for the production of images of high quality.

In another object of the present invention there is provided a process for developing images with a synthetic developer composition.

It is yet another object of the present invention to provide a process for developing electrostatic latent images wherein a synthetic developer composition is desirably agitated in a development zone situated between an imaging member and a transporting member comprised of a stationary shell containing therein rotating magnets.

An additional object of the present invention resides in the provision of a magnetically agitated development process whereby toner particles are continuously available immediately adjacent to the imaging surface thus allowing full development of the images involved including development of all solid areas.

A further object of the present invention resides in a development process wherein undesirable bead carry out is substantially eliminated.

In a further object of the present invention there is provided a development process wherein there is selected a synthetic developer composition.

These and other objects of the present invention are accomplished by providing a development process wherein toner particles are rendered continuously available immediately adjacent to an imaging member, and toner particles are transferred from one layer of carrier particles to another layer of carrier particles in a development zone. More specifically, the improved process of the present invention comprises providing a development zone situated between an imaging member and a transporting member containing a shell with rotating magnets therein, transporting a synthetic developer composition into the development zone by causing the magnets in the stationary shell to rotate, causing movement of the imaging member, thereby causing the developer particles to be desirably agitated in the development zone, wherein the developer composition is comprised of toner resin particles and carrier particles comprised of certain toner resin particles and magnetite. The imaging member and transporting member which are caused to move at relative speeds are in close proximity to each other; that is, they are at a distance of from about 0.1 mm (millimeters) to about 1.5 mm, and preferably from about 0.4 mm to about 1.0 mm.

In one embodiment, the present invention is directed to a process for causing the development of electrostatic latent images on an imaging member, comprising providing a development zone encompassed by an imaging member, and a stationary transporting member containing therein transporting magnets, causing the imaging member to move at a speed of from about 5 cm/sec to about 50 cm/sec, causing the transporting magnets to rotate at a speed of from about 200 to about 2,000 revolutions per minute, maintaining a distance between the imaging member and the stationary member of from about 0.10 millimeters to about 1.5 millimeters, adding developer particles to the development zone, which particles are comprised of toner particles, and carrier particles containing resin and magnetite particles, thus whereby the toner particles migrate from one layer of carrier particles to another layer of carrier particles in the development zone.

In a further embodiment of the present invention there is provided an improved process for developing electrostatic latent images which comprises (1) providing a development zone situated between an imaging member and a transporting member, (2) providing in close proximity to the development zone a stationary shell containing rotating magnets therein, (3) transporting a synthetic developer composition into the development zone by causing the magnets in the stationary shell to rotate, (4) causing movement of the imaging member, the imaging member moving in a direction opposite to the direction of movement of the rotating magnets, wherein the developer particles are desirably agitated in the development zone by magnetic means, and wherein developer particles are available immediately adjacent the imaging member, which developer particles are comprised of toner resin particles and carrier particles comprised of resin particles and magnetite, the distance between the imaging member and stationary shell being from about 0.1 mm to about 1.5 mm.

There is also provided in accordance with the present invention an electrostatographic imaging process wherein latent electrostatic images are developed with an apparatus containing an imaging means, a charging means, an exposure means, a devleopment means, and a fixing means, the improvement residing in the development means comprising in operative relationship, a transporting means and a development zone situated between the imaging means and the transporting means, the development zone containing therein toner particles, and carrier particles, comprised of toner resin particles and magnetic particles, and wherein the imaging means is caused to move at a speed of from about 5 cm/sec to about 50 cm/sec, the transporting means is caused to move developer particles at a speed of from about 6 cm/sec to about 100 cm/sec, the means for imaging and the means for transporting having a distance therebetween of from about 0.10 mm to about 1.5 mm, wherein the transporting means is comprised of a stationary shell containing therein rotating magnets, and wherein the means for imaging and the magnets are moving at different speeds.

More specifically, the process of the present invention can be selected for use in electrostatographic systems as illustrated for example in FIG. 3. This development system with a development zone as described herein results in a number of advantages over conventional imaging systems including, for example, agitation of developer particles as described herein, maximum solid area and line development, as the charge on the toner particles neutralizes the field emanating from the image charge, and development, limited by image field neutralization enables the development of low voltage images associated with thin image bearing members. Furthermore, for a particular image potential the amount of toner particles deposited on the imaging member can be within certain limits substantially independent of the spacing between the transporting member and the imaging member. Furthermore, the process as described utilizes as a developer composition a synthetic developer composition comprised of known toner resin particles and carrier particles containing certain resins and magnetic particles.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENT

Figure 1:
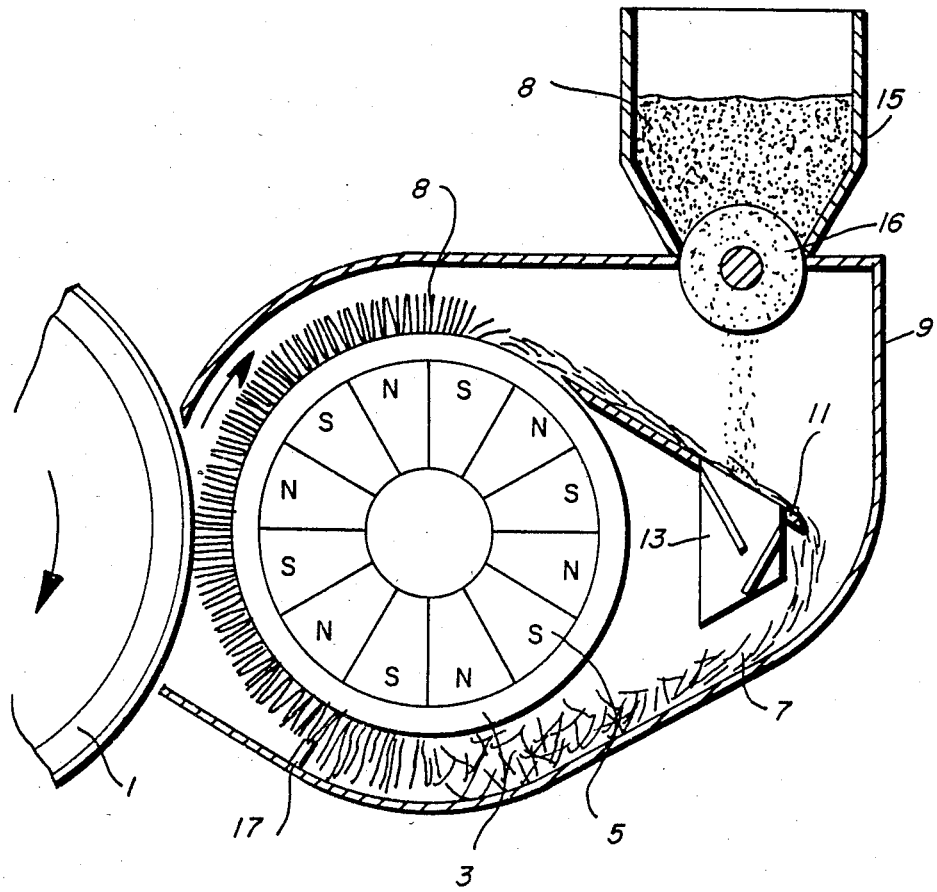
FIG. 1 is a partially schematic, cross-sectional view of the development system of the present invention.

Illustrated in FIG. 1 is one process embodiment of the present invention comprised of an imaging member 1, a stationary shell 3, rotating magnets 5, developer particles 8, development container 9, pick-off baffle housing 11, mixing baffle 13, developer container means 15, toner dispensing means 16, and trim bar 17, the components moving in the direction illustrated by the arrows. Generally in operation, the imaging member is moving at a relative speed in opposite direction to the movement of the rotating magnets. This movement causes developer particles to be transported to a development zone situated between the imaging member and stationary shell whereby the toner particles contained in this zone are desirably agitated. More specifically, the imaging member is moving at a relative speed in opposite direction to the movement of the rotating magnets contained in the stationary shell, wherein the rotating magnets provide a magnetic force causing synthetic developer particles 8 comprised of toner particles and carrier particles, contained in the reservoir 9, to be attracted thereto. As developer particles are transported on the stationary shell, they are contacted by the adjustable trim bar 17, enabling a selected amount of developer particles to remain on the stationary shell. While it is not desired to be limited by theory, it is believed that the developer particles desirably transport as a result of the number of magnet pole pairs, and the magnet rotation rate. Specifically, the developer particles which are in the form of chains continually flip, as a pole pair passes under the shell. These developer chains travel a distance of approximately one chain length and continuously flip and move along the shell providing high agitation at high rotation rates, and a continuous supply of developer particles through the development zone. It is believed critical to the process of the present invention to effect high agitation in the development zone in order to obtain improved development.

This developer agitation allows the toner particles adhering to the carrier particles to migrate towards the imaging member with the toner particles closest to the imaging member being deposited on the imaging surface. Accordingly, the carrier particles adjacent to the imaging surface lose some of the toner particles adhering thereto, which toner particles must be replaced in order to continue to achieve high quality development, and particularly solid area development. Maximum agitation, which is preferred is obtained when the development zone is thin, that is, the developer particles contained in the zone range in thickness of from about 0.10 millimeters to about 1.5 millimeters, and preferably from about 0.3 millimeters to about 1.0 millimeters.

When the imaging member is positively charged an electrostatic force is directed towards the imaging member from the negatively charged toner particles. In the absence of developer agitation, the electrostatic force on the toner particles is not sufficient under normal conditions to overcome toner adhesion, thus the toner particles are retained on the carrier particles. However, when agitation is present in the development zone the toner which remains between two carrier particles can easily transfer. Accordingly, the availability of toner particles for solid area development is enhanced with agitation and nearly all of the toner particles in the developer composition will deposit on the image bearing member.

Figure 2:
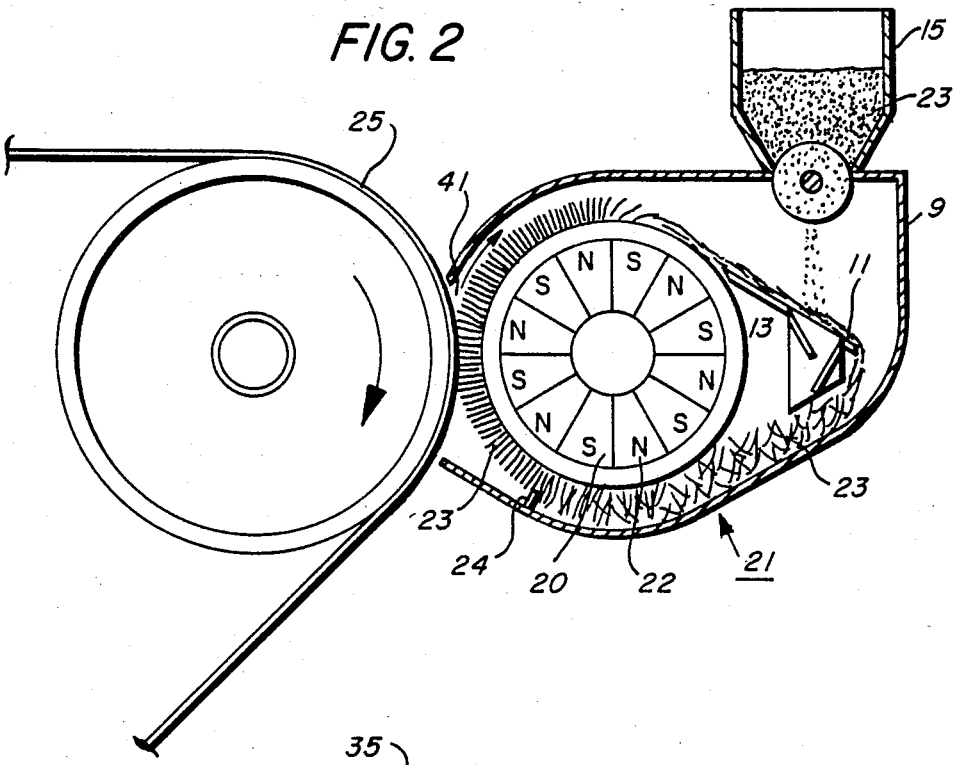
FIG. 2 illustrates an embodiment of the present invention wherein a flexible imaging member is selected.

Illustrated in FIG. 2 is essentially the same process and apparatus as illustrated in FIG. 1 with the exception that the imaging member 25 is comprised of a substrate containing thereover a photogenerating layer of trigonal selenium, metal phthalocyanine, metal free phthalocyanine, or vanadyl phthalocyanine dispersed in a resinous binder, such as polyvinyl carbazole, and a charge transport overcoating layer containing a diamine dispersed in a resinous binder composition. In this variation, the imaging member which is flexible is caused to deflect by the developer particles contained in the development zone thereby further aiding in agitation of the developer particles. With further reference to FIG. 2, there is illustrated flexible imaging member 25, transporting member 22, containing a stationary shell 21, rotating magnets 20, developer particles 23, comprised of toner resin particles, and carrier particles, wherein the carrier particles are comprised of resin particles and magnetite particles, metering blade 24, and high magnetic field region 41 situated between the imaging member and transporting means. The other components illustrated are as specified with reference to FIG. 1. In operation the developer particles 23 are transported on the transporting means, subsequent to metering by blade 24, with the metering controlling the thickness of the developer layer, wherein the toner particles are caused to migrate to the imaging member and are agitated in the development zone situated between the imaging member and transporting member, is as described herein with reference to FIG. 1, for example.

The length of the development zone depends, for example, on the configuration of the image bearing member, and the configuration of the developer transport member. In a preferred embodiment, the image bearing member is a belt partially wrapped or arced around a development roll, which roll has a diameter which is typically from about 2 centimeters to about 6.4 centimeters. In this configuration, the length of the development zone, and contact between the developer and flexible imaging member is from about 0.5 cm to about 5 cm, with a preferred length being from about 1 centimeter to about 2 centimeters. Idler rolls positioned against the backside of the belt can be used to alter the belt path.

Figure 3:
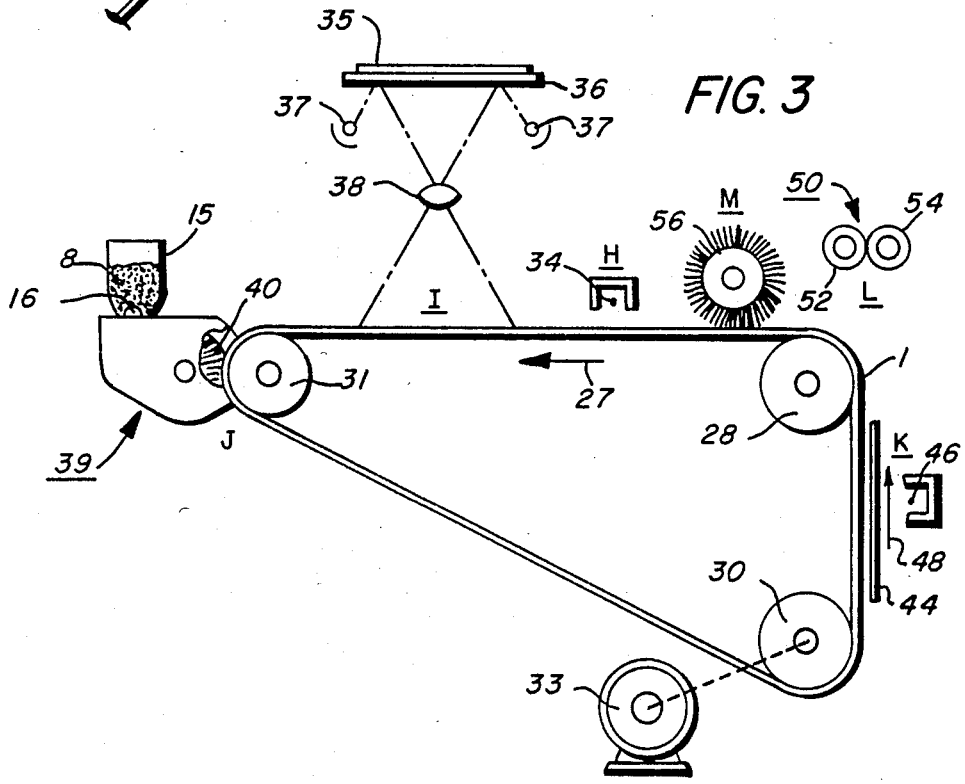
FIG. 3 illustrates an embodiment of the process of the present invention in an electrostatographic imaging system.

The process of the present invention is useful in many imaging systems, including electronic printers, and electrostatographic copying machines such as those utilizing known xerographic apparatuses. There is illustrated in FIG. 3 an electrophotographic printing machine with deflected flexible imaging member 1, as described in U.S. Pat. No. 4,265,990, the disclosure of which is totally incorporated herein by reference, having a photoconductive surface deposited on a conductive substrate such as aluminized Mylar, which is electrically grounded and an overcoating amine transport layer.

The imaging member 1, can thus be comprised of numerous suitable materials, as described herein, however, for this illustration the photoconductive material is comprised of a photogenerating layer of trigonal selenium, or vanadyl phthalocyanine, overcoated with a transport layer containing small molecules of N,N,N'-tetraphenyl-[1,1'biphenyl]4,4'-diamine, or similar diamines dispersed in a polycarbonate resinous binder. With further reference to FIG. 3, deflected flexible imaging member 1 moves in the direction of arrow 27 to advance successive portions of the photoconductive surface sequentially through the various processing stations disposed about the path of movement thereof. The imaging member is entrained about a sheet-stripping roller 28 and drive roller 30. A tensioning system now shown includes a roller 31 having flanges on opposite sides thereof to define a path through which member 1 moves. Roller 31 is mounted on each end of guides attached to the springs. Springs 32 not shown are tensioned such that roller 31 presses against the imaging belt member 1. In this way, member 1 is placed under the desired tension. The level of tension is relatively low permitting member 1 to be relatively easily deformed. With continued reference to FIG. 3, drive roller 30 is mounted rotatably and in engagement with member 1. Motor 33 rotates roller 30 to advance member 1 in the direction of arrow 27. Roller 30 is coupled to motor 33 by suitable means such as a belt drive. Sheet-stripping roller 28 is freely rotatable so as to readily permit member 1 to move in the direction of arrow 27 with a minimum of friction.

Initially, a portion of imaging member 1 passes through charging station H. At charging station H, a corona generating device, indicated generally by the reference numeral 34, charges the photoconductive surface of imaging member 1 to a relatively high, substantially uniform potential.

The charged portion of the photoconductive surface is then advanced through exposure station I. An original document 35 is positioned face down upon transparent platen 36. Lamps 37 flash light rays onto original document 35. The light rays reflected from original document 35 are transmitted through lens 38 forming a light image thereof. Lens 38 focuses the light image onto the charged portion of the photoconductive surface to selectively dissipate the charge thereon. This records an electrostatic latent image on the photoconductive surface which corresponds to the informational areas contained within original document 35.

Thereafter, imaging member 1 advances the electrostatic latent image recorded on the photoconductive surface to development station J. At development station J, a magnetically agitated development system, indicated generally by the reference numeral 39, reference FIG. 1, advances a developer material into contact with the electrostatic latent image. The magnetically agitated development system 39 includes a developer roller or shell 40 on which a layer of synthetic developer material is transported comprising resin and magnetic carrier particles and toner particles into contact with the deflected flexible imaging member 1. As shown, developer roller 40 is positioned such that the blanket of developer material deforms imaging member 1 in an arc, such that member 1 conforms at least partially, to the configuration of the synthetic developer material. The electrostatic latent image attracts the toner particles from the carrier granules forming a toner powder image on the photoconductive surface of member 1.

Imaging member 1 then advances the toner powder image to transfer station K. At transfer station K, a sheet of support material 44 is moved into contact with the toner powder image. The sheet of support material 44 is advanced to transfer station K by a sheet feeding apparatus (not shown). Preferably, the sheet feeding apparatus includes a feed roll contacting the uppermost sheet of a stack of sheets. The feed roll rotates so as to advance the uppermost sheet from the stack into a chute. The chute directs the advancing sheet of support material into contact with the photoconductive surface of member 1 in a timed sequence so that the toner powder image developed thereon contacts the advancing sheet of support material at transfer station K.

Transfer station K includes a corona generating device 46 which sprays ions onto the backside of sheet 44. This attracts the toner powder image from the photoconductive surface to sheet 44. After transfer, sheet 44 moves in the direction of arrow 48 onto a conveyor (not shown) which advances sheet 44 to fusing station L.

Fusing station L includes a fuser assembly, indicated generally by the reference numeral 50, which permanently affixes the transferred toner powder image to sheet 44. Preferably, fuser assembly 50 includes a heated fuser roller 52 and a back-up roller 54. Sheet 44 passes between fuser roller 52 and back-up roller 54 with the toner powder image contacting fuser roller 52. In this manner, the toner powder image is permanently affixed to sheet 44. After fusing, a chute guides the advancing sheet 44 to a catch tray for subsequent removal from the printing machine by the operator.

After the sheet of support material is separated from the photoconductive surface or imaging member 1, some residual particles remain adhering thereto, which particles are removed from the photoconductive surface to cleaning station M. Cleaning station M includes a rotatably mounted fibrous brush 56 in contact with the photoconductive surface. The particles are cleaned from the photoconductive surface by the rotation of brush 56 in contact therewith. Subsequent to cleaning, a discharge lamp (not shown) floods photoconductive surface 12 with light to dissipate any residual electrostatic charge remaining thereon prior to the charging thereof for the next successive imaging cycle.

The imaging member can be either rigid or flexible and can be comprised of a number of suitable known materials. Thus, for example, the imaging member can be a photoconductive member comprised of amorphous selenium, amorphous selenium alloys, including alloys of selenium tellurium, selenium arsenic, selenium antimony, selenium tellurium arsenic, cadmium sulfide, zinc oxide, and the like. Additionally, the selenium or selenium alloys can be doped with various suitable substances such as halogens in an amount of from about 5 parts to 200 parts per/million. Illustrative examples of flexible organic materials for the imaging member include layered organic photoreceptors comprised of a substrate, a photogenerating layer, and an amine transport layer, such as those described in U.S. Pat. No. 4,265,990, the disclosure of which is totally incorporated herein by reference. As examples of photogenerating layers, there can be selected metal phthalocyanines, metal free phthalocyanines, squaraine compositions, vanadyl phthalocyanine, selenium, trigional selenium, and the like, with vanadyl phthalocyanine and trigonal selenium being preferred. Examples of transport layer molecules include the diamine compositions as described in U.S. Pat. No. 4,265,990.

Generally, the photogenerating pigment and the amine transport molecules are dispersed in an inactive resinous binder composition in various effective amounts. Thus, for example, the photogenerating pigment vanadyl phthalocyanine is present in the photogenerating layer in an amount of from about 5 percent to 35 percent, while the amine transport molecule is present in the resinous binder in an amount of from about 40 percent to about 80 percent. Examples of resinous materials include those as described in U.S. Pat. No. 4,265,990, such as polycarbonates, polyvinylcarbazole, polyesters, and the like.

With regard to the transporting member it is generally comprised of a stationary shell of aluminum having a circumference of from about 6 cm to about 25 cm and preferably from about 10 cm to about 20 cm. The stationary shell generally is of a thickness of from about 1/32 in. to about 3/32 in. Other suitable materials can be selected for the stationary shell including for example, stainless stain, brass, conductively coated formed plastic and the like.

Magnets contained in the shell are secured to the core thereof as shown in FIG. 1 for example, these magnets being 8, 12, 18, or 24 pole magnets. More specifically, the magnets have a length of from about 300 millimeters to about 400 millimeters, a width of from about 5 millimeters to about 20 millimeters, and a thickness of from about 15 millimeters to about 30 millimeters. These magnets are commercially available and can be comprised of known materials such as ceramic magnetic materials including strontium ferrites.

The magnets are generally moving at a speed of from about 200 revolutions per minute to about 2,000 revolutions per minute and preferably at a speed of from about 900 revolutions per minute to about 1,100 revolutions per minute. Additionally, each magnet generates a magnetic field of from about 450 gauss to about 1,000 gauss, and preferably, magnets are selected so as to generate a field of from about 700 gauss to about 900 gauss.

A very important feature in the process of the present invention resides in the synthetic developer composition. This developer composition is identified as synthetic in that it contains as carrier particles, resin particles and magnetic particles as specifically illustrated hereinafter.

Various suitable toner resin particles can be selected for the developer composition of the present invention. These toner particles can include resin particles, pigment particles, a low molecular weight waxy material, and as an optional component, a charge enhancing additive for the purpose of, for example, imparting a triboelectric charge to the toner particles. Thus, for example, a positively charged toner composition useful in the present invention is comprised of resin particles, containing polyester resins, styrene butylmethacrylate resins, or styrene butadiene resins, pigment particles, a low molecular weight waxing material, such as a low molecular weight polyethylene or polypropylene, and a charge enhancing additive selected from the group consisting of alkylpridinium halides, organic sulfate, and organic sulfonate additives. Specific illustrative examples of alkyl pyridinium compounds include cetyl pyridinium chloride, reference for example, U.S. Pat. No. 4,298,672, the disclosure of which is totally incorporated herein by reference, and stearyl dimethyl phenethyl toluene sulfonate reference U.S. Pat. No. 4,338,390, the disclosure of which is totally incorporated by herein by reference.

Illustrative examples of toner resins include polyesters, styrene/methacrylate resins, polyamides, epoxies, polyurethanes, vinyl resins and polymeric esterification products of a dicarboxylic acid and a diol comprising a diphenol. Suitable vinyl resins include homopolymers or copolymers of two or more vinyl monomers. Typical examples of vinyl monomeric units include: styrene, p-chlorostyrene vinyl naphthylene, vinyl choloride, vinyl bromide, vinyl fluoride, ethylenically unsaturated mono-olefins such as ethylene, propylene, butylene, isobutylene and the like; vinyl esters such as vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

The preferred toner resins of the present invention are selected from polystyrene methacrylate resins, polyester resins such as those described in U.S. Pat. No. 3,655,374, the disclosure of which is totally incorporated herein by reference, polyester resins resulting from the condensation of dimethylterephthalate, 1,3 butanediol, and pentaethythriol, and Pliolite resins which are commercially available from Goodyear Corporation as S5A. The Pliolite resins are believed to be copolymer resins of styrene and butadiene, wherein the styrene is present in an amount of from about 80 weight percent to about 95 weight percent, and the butadiene is present in an amount of from about 5 weight percent to about 20 weight percent. A specific styrene butadiene resin found highly useful in the present invention is comprised of about 89 percent of styrene, and 11 percent of butadiene.

Various suitable colorants and/or pigment particles may be incorporated into the toner particles, such materials being well known and including, for example, carbon black, Nigrosine dye, magnetic particles such as Mapico Black, which contains a mixture of iron oxides, and the like. The pigment particles are present in the toner in sufficient quantities so as to render it highly colored in order that it will form a visible image on the recording member. Thus, for example, the pigment particles, with the exception of magnetic materials, should be present in the toner composition in an amount of from about 2 percent by weight to about 15 percent by weight, and preferably from about 2 percent by weight to about 10 percent by weight. With regard to magnetic pigments such as Mapico Black, they are generally incorporated into the toner composition in an amount of from about 10 percent by weight to about 60 percent by weight, and preferably in an amount of from about 20 percent by weight to about 30 percent by weight.

While the magnetic particles can be present in the toner composition as the only pigment, these particles may be combined with other pigments, such as carbon black. Thus, for example, in this embodiment of the present invention, the other pigments including carbon black are present in an amount of from about 5 percent by weight to about 10 percent by weight, with the magnetic pigment being present in an amount of from about 10 to about 60 percent by weight. Other percentage combinations of other pigments and magnetic pigments, may be selected provided the objectives of the present invention are achieved.

The low molecular weight waxy material incorporated into the toner composition generally has a molecular weight of from between about 500 and about 20,000, and preferably is of a molecular weight of from about 1,000 to about 5,000. Illustrative examples of low molecular weight waxy materials included within the scope of the present invention are polyethylenes commercially available from Allied Chemical and Petrolite Corporation, Epolene N-15, commercially available from Eastman Chemical Products Incorporation, Viscol 550-P, a low molecular weight polypropylene available from Sanyo Kasei K.K. and similar materials. The commercially available polyethylenes selected have a molecular weight of about 1,000 to 1,500 while the commercially available polypropylenes incorporated into the toner compositions of the present invention have a molecular weight of about 4,000. Many of the polyethylene and the polypropylene compositions useful in the present invention are illustrated in British Pat. No. 1,442,835.

The low molecular weight wax materials, such as low molecular weight polyethylenes and polypropylenes can be incorporated into the toner compositions in various amounts, however, generally these waxes are present in the toner composition in an amount of from about 1 percent by weight to about 10 percent by weight, and preferably in an amount of from about 2 percent by weight to about 5 percent by weight.

The charge enhancing additives are mixed into the developer composition so as to be present in an amount of from about 0.5 percent to about 10 percent by weight, and preferably from about 1 percent by weight to about 5 percent by weight, based on the total weight of the toner particles. The charge control additives can either be blended into the developer mixture or coated onto the pigment particles such as carbon black. The preferred charge enhancing additives incorporated into the toner compositions of the present invention include cetyl pyridinium chloride, and stearyl dimethyl phenethyl ammonium para-toluene sulfonate.

The toner resin is present in an amount to provide a toner composition which will result in a total of about 100 percent for all components. Accordingly, for non-magnetic toner compositions the toner resin is generally present in an amount of from about 60 percent by weight to about 90 percent by weight, and preferably of from about 80 percent by weight to about 85 percent by weight. In one embodiment, thus, the toner composition can be comprised of 90 percent by weight of resin particles, 5 percent by weight of pigment particles, such as carbon black, 3 percent by weight of the charge enhancing additive material, and 2 percent by weight of the low molecular weight wax.

One preferred toner resin material is comprised of about 67 percent by weight of a styrene butadiene copolymer, containing about 88 to 91 percent by weight of styrene, and about 8 to 12 percent by weight of butadiene, or 67 percent by weight of a branched polyester resin obtained from the reaction of bis phenol A, propylene oxide and fumaric acid, 25 percent by weight of a cross-linked styrene n-butyl methacrylate resin, containing 58 percent by weight of styrene and 42 percent of weight by n-butyl methacrylate, 6 percent by weight of carbon black, and 2 percent by weight of a polypropylene wax of a molecular weight of from about 2,000 to about 7,000. The cross-linked resin contains about 0.2 percent of divinyl benzene.

Another preferred toner composition is comprised of a polyester resin as disclosed in U.S. Pat. No. 3,655,374, which resin is present in an amount of about 80 percent by weight, and magnetic pigments, such as magnetite, including Mapico Black which is a mixture of iron oxides, present in an amount of about 20 percent by weight, with no carbon black being present in this composition.

Additionally, there can be incorporated into the toner composition various additives such as silica particles, including Aerosil R972, and various known fatty acids of metal salt including zinc stearate. These materials are incorporated primarily for assisting and providing a negative triboelectric charge to the toner particles.

The unique carrier composition of the present invention, which has a diameter of from about 50 microns to about 250 microns, is comprised of resin particles, magnetic particles, and carbon black. Thus, for example, the carrier particles can be comprised of from about 20 percent to about 30 percent of certain resin particles as illustrated hereinafter, including styrene and butylmethacrylate polymers, polymethacrylates, and from about 50 percent by weight to about 70 percent by weight of magnetites including known magnetites, which are mixtures of iron oxides either of a cubic shape or an acicular shape, and from about 0 percent to about 10 percent by weight of carbon black, either in a conductive form or non-conductive form.

Examples of resin particles useful for the carrier composition include polyamides, epoxies, polyurethanes, vinyl resins, and polymeric esterification products of a dicarboxylic acid and a diol comprising a diphenol. Any suitable vinyl resin may be selected including homopolymers or copolymers of two or more vinyl monomers. Typical of such vinyl monomeric units include: styrene, p-chlorostyrene vinyl naphthylene unsaturated monoolefins such as ethylene, propylene, butylene, isobutylene and the like; vinyl halides such as vinyl chloride, vinyl bromide, vinyl fluoride, vinyl acetate, vinyl propionate, vinyl benzoate, vinyl butyrate and the like; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylaphachloroacrylate, methyl methacrylate, ethyl methacrylate, butyl methacrylate, and the like, methacrylonitrile, acrylamide, vinyl ethers, such as vinyl ether, vinyl isobutyl ether, vinyl ethyl ether, and the like; vinyl ketones such as vinyl methyl ketone, vinyl hexyl ketone, methyl isopropyl ketone and the like; vinylidene halides such as vinylidene chloride, vinylidene chlorofluoride and the like, and N-vinyl indole, N-vinyl pyrrolidene and the like; and mixtures thereof. The preferred materials for the carrier particles are comprised of a styrene butadiene copolymer resin and a styrene n-butyl methacrylate copolymer resin.

As one preferred carrier resin there can be selected the esterification products of a dicarboxylic acid and a diol comprising a diphenol. These materials are illustrated in U.S. Pat. No. 3,655,374, the disclosure of which is totally incorporated herein by reference, the diphenol reactant being of the formula as shown in Column 4, beginning at line 5 of this patent and the dicarboxylic acid being of the formula as shown in Column 6. Other preferred toner resins include styrene/methacrylate copolymers, and styrene/butadiene copolymers.

Other specific preferred resins selected for the carrier compositions of the present invention include polymethylmethacrylates, vinyl halide copolymers, particularly vinyl chloride copolymers, and the like.

Illustrative examples of the magnetite compositions included within the resin particles are magnetites, such as cubically shaped Mapico Black, commercially available from Cities Service, acicular magnetites, commercially available from Pfizer Corporation, and the like, with cubical Mapico Black being preferred. These magnetites are believed to be comprised of a mixture of iron oxides.

Conductive or non-conductive carbon black particles are included in the carrier composition in the amount of from about 0 percent by weight to about 10 percent by weight. By conductive in accordance with the present invention is meant that the carrier particles with carbon black have a conductivity of from about $10^{-6}$ (ohm-cm)$^{-1}$ at 200 volts per millimeter to about $10^{-9}$ (ohms-cm)$^{-1}$ at 200 volts per millimeter, and preferably from about $10^{-7}$ (ohm-cm)$^{-1}$ at 200 volts per millimeter to about $10^{-8}$ (ohm-cm)$^{-1}$ at 200 volts per millimeter.

Developer compositions can be prepared by mixing in effective amounts the toner composition described herein with the carrier composition comprised of resin particles, magnetite particles, and carbon black particles. More specifically, a developer composition can be obtained by mixing about 98 parts of carrier particles with 2 parts of toner paticles.

The following specific examples are now being provided to illustrate preferred embodiments of the present invention, however, it is not intended to be limited to the process parameters disclosed. In these examples parts and percentages are by weight unless otherwise indicated.

EXAMPLE I

Carrier particles were prepared by melt blending at 250° F. in a Banbury mixture, for five minutes, 35% by weight of a styrene butadiene copolymer resin, containing about 89% by weight of styrene, and 11% by weight of butadiene, commercially available as Pliolite from Goodyear Chemicals Company, 60% by weight of Mapico Black, commercially available from Cities Services, and 5% by carbon black, commercially available as Vulcan carbon black XC 72-R. The resulting composition was then passed through a roll mill for about five minutes and subsequent to cooling, this composition was ground in a Fitz mill. The resulting particles were then screened to a particle size of between about 53 and 106 microns.

A second carrier composition was prepared by repeating the above procedure with the exception that there was used 8% by weight of carbon black, and 57% by weight of the Mapico Black.

EXAMPLE II

Carrier particles were prepared by repeating the procedure of Example I with the exception that there was selected 40% by weight of the Pliolite resin, and 0% by weight of carbon black.

Additionally, carrier particles were prepared by repeating the procedure of Example I with the exception that there was selected 33% by weight of a polymethylmethacrylate resin, commercially available from E. I. DuPont & Co., 8% by weight of carbon black particles, and 60% by weight of Mapico Black particles.

EXAMPLE III

There was prepared by melt extrusion in a twin screw extrusion apparatus maintained at 280° F., and at 150 pounds per hour, carrier particles containing 60% by weight of Mapico Black, commercially available from Cities Services, 40% by weight of polymethylmethacrylate, commercially available from E. I. DuPont & Co., which carrier particles were ground in a Fitz mill and screened to a particle size of from 53 microns to 106 microns.

Additionally, other carrier particles were prepared by repeating the above procedure with the exception that there was further included in the particles 8% by weight of carbon black, commercially available as Vulcan XC 72-R, and further the carrier particles contained 32% by weight of polymethylmethacrylate resinous particles.

The following Table details the conductivity of various carrier compositions, and the toner charge to diameter ratio for toner particles of 10 microns in diameter as measured on a charge spectrograph, which values is in femtocoulombs per micron, and is listed under the heading "$Q/D_{10}$"

| Carrier Composition | Conductivity (ohm-cm)$^{-1}$ at 650 volts per millimeter | $Q/D_{10}$ fc/u | Process |
|---|---|---|---|
| 40% Pliolite, 60% Mapico black | Insulating | $+.22^a$ | Banbury |
| 35% Pliolite, 60% Mapico black, 5% Vulcan | Insulating | $+.92^a$ | Banbury |
| 32% Pliolite, 60% Mapico black, 8% Vulcan | Insulating | $+.51^a$ | Banbury |
| 40% PMMA, 60% Mapico black | Insulating | $-1.4^b$ | Extruder |
| 32% PMMA, 60% Mapico black, 8% Vulcan | $3.3 \times 10^{-7}$ | $-1.3^b$ | Extruder |
| 32% PMMA, 60% Mapico black, 8% Vulcan | Insulating | $-1.1^b$ | Banbury |
| 34% Styrene resin, 60% Mapico black, 6% Vulcan | $1.6 \times 10^{-10}$ | $-1.2^c$ | Extruder |
| 32% Styrene Resin, 60% Mapico black, 8% Vulcan | $3 \times 10^{-9}$ | $1.1^b$ $-1.0^C$ | Extruder |
| 36% Styrene resin, 60% Mapico black, 4% Vulcan | Insulating | $-1.3^b$ | Extruder |
| 36% Styrene resin, 60% MO4232, 4% Vulcan | Insulating | $1.2^b$ | Extruder |
| 36% Pliolite, 60% Mapico black, 4% Vulcan | $2 \times 10^{-9}$ | $+0.37^a$ | Extruder |
| 34% Pliolite, 60% Mapico black, 6% Vulcan | $5 \times 10^{-9}$ | $+0.85^a$ | Extruder |
| 32% Pliolite, 60% Mapico black, 8% | $1 \times 10^{-8}$ | $+0.62^a$ | Extruder |

-continued

| Carrier Composition | Conductivity (ohm-cm)$^{-1}$ at 650 volts per millimeter | Q/D$_{10}$ fc/u | Process |
|---|---|---|---|
| Vulcan | | | |

[a]toner containing 92% by weight of styrene-n-butyl methacrylate, 6% by weight of Regal 330 carbon black, and 2% by weight of cetyl pyridinium chloride.
[b]toner consisting of 74% of polyester resin, 6% carbon black and 20% Mapico black.
[c]toner containing 88 percent styrene n-butyl methacrylate (58/42), 5 percent carbon black (R330), 2 percent cetyl pyridinium chloride, and 5 percent of polypropylene wax.
PMMA = polymethylmethacrylate
Styrene = styrene n-butylmethacrylate copolymer (58/42) resin
Vulcan = Vulcan carbon black.

The above developer compositions, prepared by mixing 97 parts of carrier particles, 75 microns in diameter with 3 parts of toner particles, a, b or c, when incorporated into xerographic imaging fixtures as illustrated in FIG. 1, amorphous selenium photoreceptor 2 and 3 resulted in images of high quality, excellent resolution, and excellent solid area coverage. Additionally, no bead carry out that is, the carrier particles were not present on the paper substrate containing the developed image, was observed after 25,000 imaging cycles.

Other modifications of the present invention may occur to those skilled in the art based upon a reading of the present disclosure and these are intended to be included within the scope of the present invention.

What is claimed is:

1. An improved process for developing electrostatic latent images comprising (1) providing a development zone situated between an imaging member and a transporting member, consisting essentially of a stationary shell containing rotating magnets therein, which magnets are rotating at a speed of from about 200 revolutions per minute to about 2,000 revolutions per minute, (2) transporting a synthetic developer composition comprised of toner particles and carrier particles wherein the carrier particles contain therein resin particles and magnetite particles in an amount of from about 10 percent by weight to about 60 percent by weight, into the development zone by causing rotation of the magnets in the stationary shell, (3) effecting movement of the imaging member in a direction opposite to the direction of movement of the rotating magnets, wherein the developer composition is desirably agitated in the development zone by magnetic means, and wherein developer particles are available immediately adjacent the imaging member; with the distance between the imaging member and stationary shell being from about 0.1 millimeter to about 1.5 millimeters.

2. A process in accordance with claim 1 wherein the imaging member is caused to move at a speed of from about 5 centimeters per second to about 50 centimeters per second, and the transporting means containing the rotating magnets is caused to move at a speed of from about 6 centimeters per second to about 100 centimeters per second.

3. A process in accordance with claim 1 wherein the imaging member is comprised of selenium, or selenium alloys.

4. A process in accordance with claim 3 wherein the selenium alloys include selenium tellurium, selenium arsenic or selenium tellurium arsenic.

5. A process in accordance with claim 1 wherein the imaging member is flexible and is comprised of a supporting substrate, a photogenerating layer, and an amine charge transport layer.

6. A process in accordance with claim 5 wherein the photogenerating layer is selected from the group consisting of metal phthalocyanines, metal free phthalocyanines, vanadyl phthalocyanines, or trigonal selenium, optionally dispersed in an inactive resinous binder.

7. A process in accordance with claim 1 wherein the carrier resin particles are comprised of a styrene butadiene resin, or a styrene n-butyl methacrylate resin.

8. A process in accordance with claim 7 wherein the resin particles are present in an amount of from 30 percent by weight to about 50 percent by weight, and the magnetite particles are present in an amount of from about 50 percent by weight to about 70 percent by weight.

9. A process in accordance with claim 7 wherein there is further included in the carrier particles from about 1 percent by weight to about 10 percent by weight of carbon black particles.

10. A process in accordance with claim 1 wherein the carrier particles are comprised of polymethylmethacrylate resin particles, from about 30 to about 50 percent by weight, and magnetite particles, from about 50 percent by weight to about 70 percent by weight.

11. A process in accordance with claim 10 wherein there is further included in the carrier particles carbon black particles.

12. A process in accordance with claim 1 wherein the magnets are rotating at a speed of from about 200 revolutions per minute to about 2,000 revolutions per minute.

13. A process in accordance with claim 1 wherein the carrier resin particles are comprised of styrene polymer compositions.

14. A process in accordance with claim 1 wherein the carrier particles are of a diameter of from about 50 to 250 microns.

15. A process in accordance with claim 1 wherein the toner resin particles are comprised of polystyrene polymers.

16. A process in accordance with claim 1 wherein the toner resin particles are comprised of polyester compositions, or styrene butadiene copolymers.

17. A process in accordance with claim 1 wherein the toner particles include therein a low molecular weight wax and charge enhancing additives.

18. A process in accordance with claim 17 wherein the wax is polypropylene, and the charge enhancing additive is cetyl pyridinium chloride.

19. An improved process for devloping electrostatic latent images consisting essentially of (1) providing a development zone situated between a flexible imaging member comprised of a supporting substrate, a photogenerating layer, and an amine charge transport layer, and a transporting member, consisting essentially of a stationary shell containing therein magnets rotating at a speed of from about 200 revolutions per minute to about 2,000 revolutions per minute; (2) thereafter transporting synthetic developer composition comprised of toner particles and carrier particles comprised of resin particles and magnetite present in an amount of from about 50 percent by weight to about 70 percent by weight, and wherein the carrier particles further include therein as an optional component carbon black particles, into the development zone by causing rotation of the magnets in the stationary shell; (3) affecting movement of the flexible imaging member in a direction opposite to the direction of movement of the rotating magnets, which imaging member is moving at a speed of from about 5 centimeters per second to about 50 centimeters per second and wherein the transporting means is moving at a speed of from about 6 centimeters per second to about 100 centimeters per second, enabling the developer composition to be desirably agitated in the development zone by magnetic means, and wherein the developer particles are immediately available adjacent the imaging member; with the distance between the imaging member and stationary shell being from about 0.1 millimeter to about 1.5 millimeters.

20. A process in accordance with claim 19 wherein the carrier resin particles are comprised of a styrene butadiene resin, or a sytrene n-butylmethacrylate resin.

21. A process in accordance with claim 20 wherein there is further included in the carrier particles from about 1 percent by weight to about 10 percent by weight of carbon black particles.

22. A process in accordance with claim 21 wherein the carrier particles are comprised of polymethacrylate resin particles, from 30 to about 50 percent by weight; and magnetite particles, from about 50 percent by weight to about 70 percent by weight.

* * * * *